US005692381A

United States Patent [19]

Garrett

[11] Patent Number: 5,692,381

[45] Date of Patent: Dec. 2, 1997

[54] APPARATUS FOR CHILLING FLUIDS

[75] Inventor: Michael E. Garrett, Woking, England

[73] Assignee: The BOC Group plc, Windlesham, England

[21] Appl. No.: 674,292

[22] Filed: Jul. 1, 1996

[30] Foreign Application Priority Data

Jul. 4, 1995 [GB] United Kingdom ..... 9513606

[51] Int. Cl.[6] ..... B65B 63/08; F25B 9/00; F25B 17/08; F25D 3/08

[52] U.S. Cl. ..... 62/60; 62/86; 62/371; 62/294; 62/480

[58] Field of Search ..... 62/60, 86, 371, 62/457.4, 457.9, 480, 294

[56] References Cited

U.S. PATENT DOCUMENTS

| | | | |
|---|---|---|---|
| 4,924,676 | 5/1990 | Maier-Laxhuber et al. | 62/59 |
| 4,928,495 | 5/1990 | Siegel | 62/4 |
| 5,038,581 | 8/1991 | Maier-Laxhuber et al. | 62/457.9 |
| 5,325,680 | 7/1994 | Baroso-Lujan et al. | 62/294 |
| 5,331,817 | 7/1994 | Anthony | 62/5 |
| 5,440,896 | 8/1995 | Maier-Laxhuber et al. | 62/269 |
| 5,447,039 | 9/1995 | Allison | 62/293 |

FOREIGN PATENT DOCUMENTS

| | | |
|---|---|---|
| 2 183 592 | 11/1985 | United Kingdom . |
| 2 280 886 | 8/1994 | United Kingdom . |
| 2 280 887 | 8/1994 | United Kingdom . |

*Primary Examiner*—William Doerrler
*Attorney, Agent, or Firm*—R. Hain Swope; Salvatore P. Pace

[57] ABSTRACT

A chiller for chilling a quantity of fluid in a vessel comprises an adsorbent for receiving and adsorbing under pressure a quantity of gas; sealing means for sealing adsorbed gas in said adsorbent and releasing means for releasing adsorbed gas from said adsorbent in a controlled manner such that the action of desorption causes a reduction in the temperature of the adsorbent and gas which acts to chill the fluid.

19 Claims, 4 Drawing Sheets

APPARATUS FOR CHILLING FLUIDS

The present invention relates to an apparatus for chilling fluids and relates particularly, but not exclusively, to an apparatus for chilling canned or bottled beverages.

BACKGROUND OF THE INVENTION

Canned or bottled beverages, such as beer, are often consumed where pre-refrigeration is unavailable. Since this is believed to have a negative effect on consumer acceptance of the product, it is desirable to have a means of pre-chilling available. Several methods of chilling the vessel for such products are known. These methods include, for example, releasing a quantity of liquid compressed butane to the atmosphere or using a cold crystallization technique. Because such methods are environmentally unfriendly and costly in materials, they have not gained widespread use. Major manufacturers are still seeking a means of pre-chilling which avoids the disadvantages associated with these methods.

It is an object of the present invention to provide a chiller for chilling canned or bottled beverages which reduces and possibly eliminates the problems associated with the above-mentioned methods.

SUMMARY OF THE INVENTION

Accordingly, the present invention provides a chiller for chilling a quantity of fluid comprising an adsorbent for receiving and adsorbing under pressure a quantity of gas; sealing means for sealing adsorbed gas in said adsorbent; releasing means for releasing adsorbed gas from said adsorbent in a controlled manner thereby causing a reduction in the temperature of the adsorbent and the gas which acts to chill the fluid.

DETAILED DESCRIPTION OF THE PREFERRED EMBODIMENTS

Figure 6:
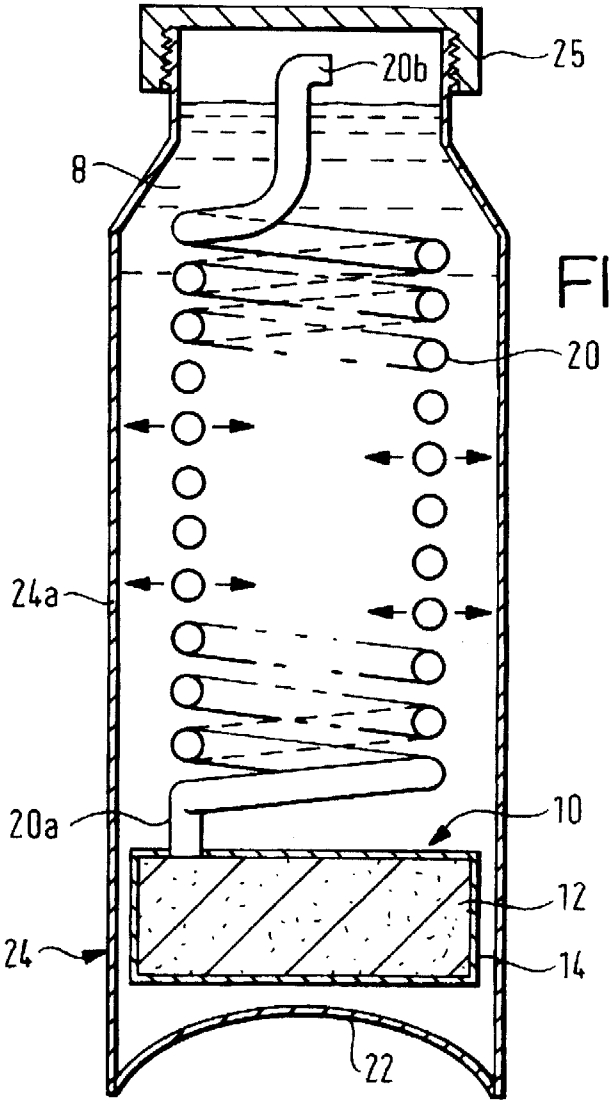
FIG. 6 is a cross-sectional view of the present invention when used in conjunction with a screw top vessel.
Figure 1:
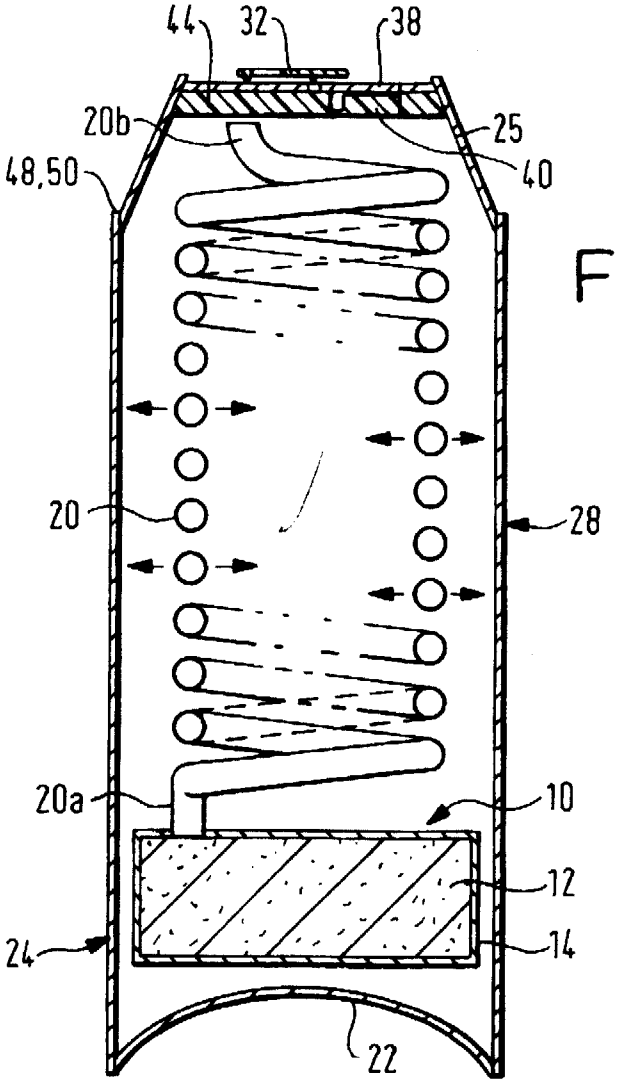
FIG. 1 is a cross-sectional view of a vessel incorporating or forming part of the present invention.

The adsorbent utilized in the chiller of the present invention advantageously may comprise any one of a number of suitable materials such as, for example, zeolites, cation exchanged zeolites, silica gel, activated carbons and carbon molecular sieves and the like, but preferably comprises activated carbon of the type sold under the trade mark "AMBERSORB". Such adsorbents are capable of adsorbing under pressure a significant quantity of gas for later release. The gas adsorbed therein can be any suitable gas that is inert to the chiller and the atmosphere. Preferably, the gas is at least partially comprised of carbon dioxide.

Gas adsorbed in the adsorbent, when released to atmospheric pressure, will experience a significant drop in temperature thereby chilling the contents of any fluid in which the chiller is situated. In particular, activated carbons can hold very large quantities of carbon dioxide, with one gram of activated carbon being capable of holding as much as 0.4 grams of carbon dioxide at 10 bar. Typically, a cooling capability of approximately 15 Kcal/mole carbon dioxide is available when pressurized to 10 bar and a beer can containing 300 ml of liquid would require above 6 Kcal to chill it through 20 degrees. Forty-four grams of carbon occupying a volume of about 100 ml would be sufficient to cool an individual can to the required temperature.

The chiller is configured so that the adsorbed gas is released to the atmosphere in a controlled manner. By this is meant that, once the sealing means is disengaged, the gas is released to the atmosphere over several minutes to that the resultant cooling effect is maximized. The preferred means of establishing a controlled release is an elongated passageway through which the adsorbed gas must pass before being released to the atmosphere. Those skilled in the art will appreciate that both the width and length of the passageway control the rate at which pressure equalization can take place and, hence, the time during which the cooling will occur.

In a preferred embodiment of the invention, the passageway defines an elongated tube in fluid connection at one end with the adsorbent and at the other end with the sealing means. The chiller tube may fit around, preferably in a spiral configuration, and be in heat exchange with a fluid storing vessel. Alternatively, the chiller is contained within the fluid storing vessel and the elongated tube is in direct contact with the fluid to be chilled. The passageway may optionally contain flow restrictions that further impede release of the adsorbed gas and lengthen the period of cooling.

The releasing means for the chiller may operate independent of or in conjunction with means for opening the fluid storing vessel. In the former instance, the releasing means permits pre-chilling of the contents of the vessel before it is opened. Preferably, the chiller is configured so that opening the fluid storage vessel also acts to disengage the sealing means and release the adsorbed gas to the atmosphere.

Preferably, the releasing means comprises a frangible structure breakable upon opening of said vessel. Conveniently, said frangible structure comprises a plug inserted into the end of the elongated tube and secured to the means to obturate the fluid storage vessel such that opening said vessel acts to remove the plug from said tube, thereby releasing the adsorbed gas. Advantageously, the tube is positioned for directing escaping gas across the surface of the fluid within the vessel prior to said gas exiting the outlet.

The present invention will now be more particularly described by way of example only with reference to the accompanying drawings. Referring to FIGS. 1 to 5, a chiller 10 according to one aspect of the present invention comprises a quantity of adsorbent 12 encased in a sealed housing 14 having a sealing means in the form of plug 16 (FIG. 2) which obturates an outlet 18 thereby preventing leakage of gas adsorbed into said adsorbent. The chiller 10 includes an elongated tube 20 in fluid connection at one end **20*a* with the adsorbent and at its other end 20*b* with plug 16 in a manner which seals its outlet 18 as will be described in detail below. In the embodiment shown in FIG. 1, the adsorbent 12 is in the form of a disk positioned on the base 22 of a fluid storage vessel 24 and tube 20 spirals upward thus passing through the interior of vessel 24 thereby facilitating efficient chilling of the contents thereof in a manner to be described in detail below. Vessel 24 is comprised of body portion 28 and cap or lid 25**.

In operation, the adsorbent is exposed to, for example, carbon dioxide, at between 6 to 10 bar, preferably between 6 to 8 bar, such that the carbon dioxide is adsorbed and, if necessary, is then sealed therein by blocking outlet 18 with plug 16. The chiller 10 may be inserted into the vessel 24 either during manufacture thereof, or prior to sealing if the outlet of the vessel will accommodate it. Such an alternative is feasible when the chiller 10 is intended for use in bottles having large diameter screw caps and the like, as shown by lid 25 in FIG. 6. In the embodiments of the present invention illustrated in FIGS. 1 to 5, vessel 24 is a beverage can having a ring-pull opening best seen in FIGS. 4 and 5. Such cans are generally made in two parts comprising a body portion 28 and lid 25 having in top surface 30 a ring-pull 32 with an opening 36°

Figure 3:
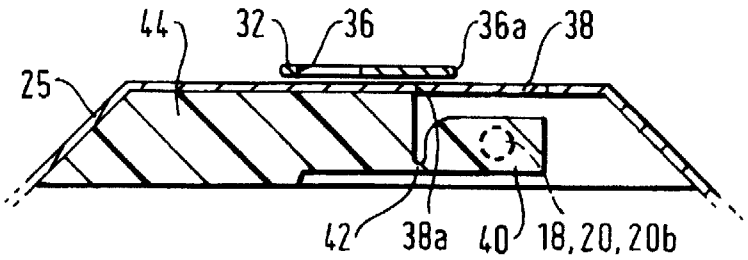
FIGS. 3 and 5 are cross-sectional views taken in the direction of arrows A—A and B—B of FIGS. 2 and 4 respectively.
Figure 5:
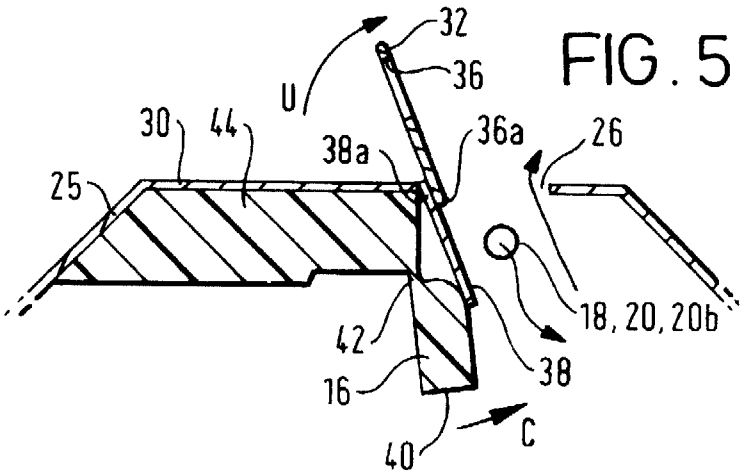

The ring-pull 32 forms no part of the present invention itself and is therefore not described in detail herein. However, it will be appreciated that a number of variations of the ring-pull are available and the present invention should not be considered to be limited to use in connection with the ring-pull described and illustrated herein. Such ring-pulls include the type having a finger engageable portion having an opening 36 which, when actuated, pivots about a fixed point at which it is attached to top surface 30 so as to force a frangible portion 38 downward into the vessel 24, thus opening it. The frangible portion 38 includes an edge 38*a* which remains attached to the top surface 30, thus preventing portion 38 falling into the interior of vessel 24. Once actuated, the frangible portion 38 remains bent downward (as shown in FIG. 5) whilst the ring-pull itself 32 may be returned to a position in which it lies flat upon top surface 30 (as shown in FIG. 3).

In one embodiment of the present invention, the opening of the vessel 24 is used to cause plug 16 to be removed from the opening 18 in the end 20*b* of tube 20 thus allowing the adsorbed gas to escape to the atmosphere. This arrangement is best shown in FIGS. 3 and 5 from which it will be seen that plug 16 includes a pivotable portion 40 which is hinged at point 42 to body portion 44 adhesively bonded to the top surface 30. Pivotable portion 40 is positioned immediately beneath the outlet 26 of the vessel 24 and is shaped in complementary fashion therewith.

Figure 2:
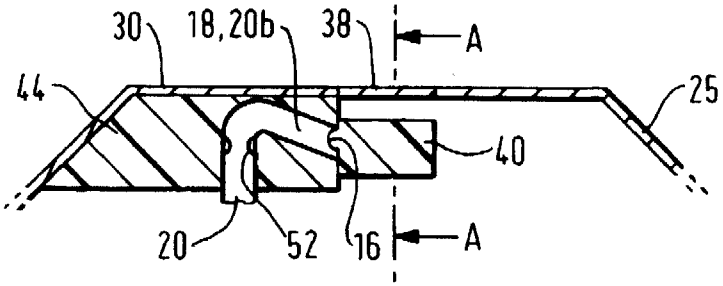
FIGS. 2 and 4 are exploded cross-sectional views of the lid portion of the vessel shown in FIG. 1 illustrating the "closed" and "open" positions, respectively.
Figure 4:
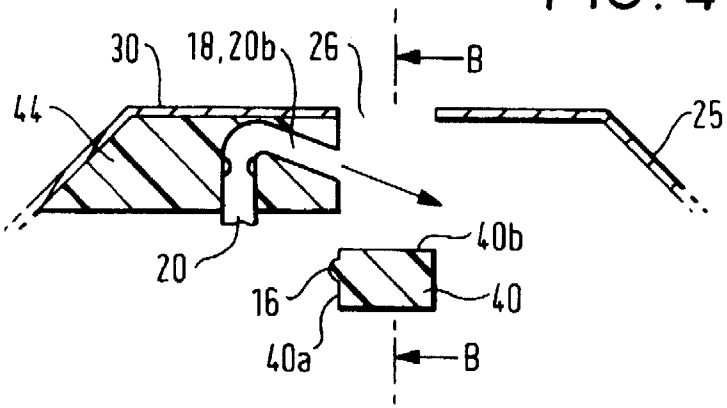

The outlet end 20*b* of tube 20 terminates within the body portion 44 such that, when in a closed position, plug 16 acts to obturate the outlet, thus preventing any gas escaping from the adsorbent. Advantageously, the plug 16 pivotable portion 40 and body portion 44 are all made of deformable plastic, thereby allowing the plug to be engageable in a "snap-fit" manner. As shown, the plug 16 preferably comprises a detent on an edge face 40*a* of pivotable portion 40 which may be pushed between its open and closed positions (FIGS. 5 and 3, respectively). In operation, the adsorbed gas is sealed in causing plug 16 to "snap-fit" into outlet 18 as shown in FIGS. 2 and 3. Once closed, the chiller 10 may be inserted into the vessel 24 at the same time as the lid 25 is placed thereon and joined thereto by swaging the mating edges 48, 50 (FIG. 1) of the body 28 and lid 25. Such a joining operation is undertaken after the vessel 24 has been filled with beverage and is thus the last of a number of production steps.

The vessel 24 is opened in the conventional manner by pulling ring-pull 36 upward thus causing the other end thereof 36a to engage with frangible portion 38 and push it downward. As frangible portion 38 is bent downward, it engages an upper surface 40b of pivotable portion 40 and thus pushes it downward causing plug 16 to sequentially disengage the outlet 26 and the outlet 18. Once the outlet 18 is clear, desorbing of the gas from adsorbent 12 will begin and the desorbed gas will pass upward through tube 20, cooling the contents of the vessel 24 as it goes. Escaping gas may be directed across the upper surface of any beverage in the vessel 24 thus cooling it even further before escaping via outlet 26. Once the contents of the vessel 24 have been sufficiently chilled, it may be dispensed in the usual manner. The rate of desorption may be controlled by an optional conventional flow restrictor 52 in FIG. 2, placed in tube 20, or by simply modifying diameter and/or the length of the tube 20 to achieve the particular rate and cooling time desired.

Figure 7:
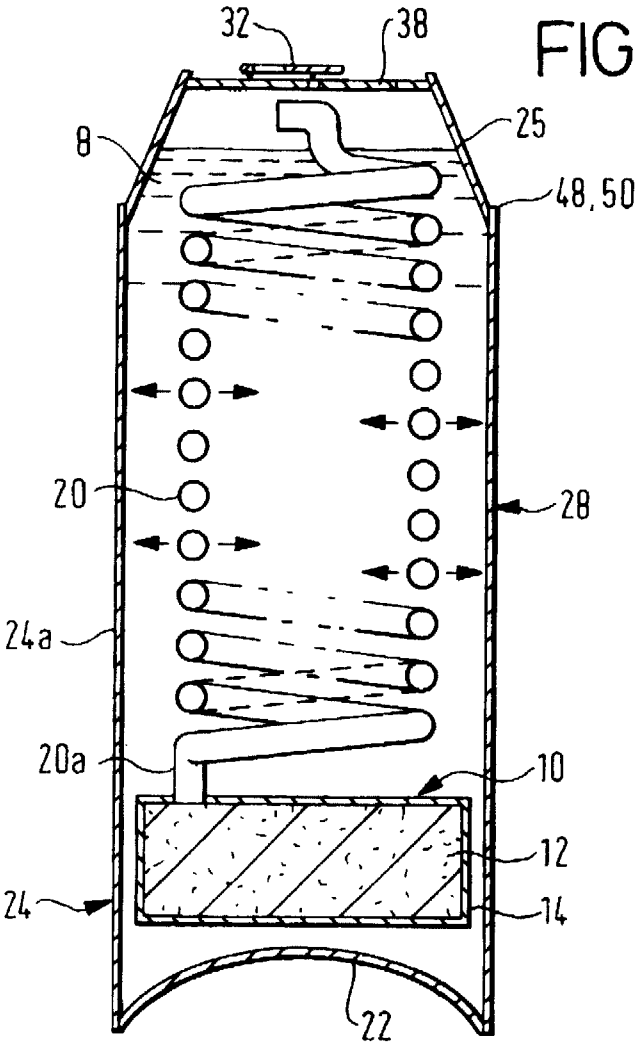
FIG. 7 is a cross-sectional view of a simplified form of the present invention.

In some arrangements, the vessel 24 is pressurized with an inert gas which effectively acts to strengthen the sidewalls to prevent buckling when subjected to large vertical loads. The pressurizing gas comprises, for example, nitrogen which also acts to fill the head space in the vessel 24 and thus prevent oxidation taking place. If the head pressure is sufficiently high, e.g. 5–10 bar, the adsorbed carbon dioxide will not need to be sealed into the adsorbent and hence the elaborate plug and tube arrangements of FIGS. 2 to 5 may be dispensed with. In this alternative arrangement shown in FIG. 7, the outlet end 20*b* of tube 20 is just positioned proximate to outlet 26 and the ring-pull 36 itself performs the same function as plug 16 thereby allowing adsorbed gas to be desorbed and passed to the atmosphere once the vessel 24 is opened, i.e. the opening of vessel 24 simultaneously initiates desorption of the gas.

Figure 8:
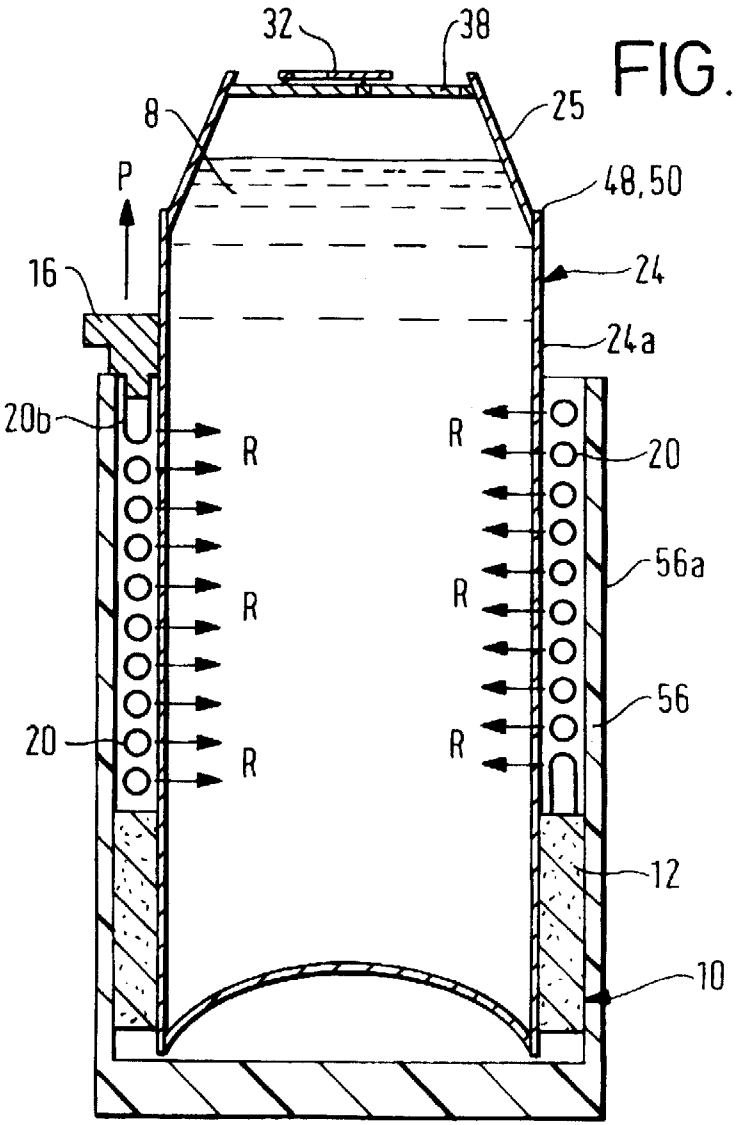
FIGS. 8 to 10 are cross-sectional views of alternative forms of the present invention.

In certain circumstances, it may be convenient to chill the outside of the vessel 24 and hence the arrangement illustrated in FIG. 8 may be employed to good effect. This arrangement is very similar to that described above save for the fact that the adsorbent 12 and spiral tube 20 are shaped and positioned such that they are in fairly intimate contact with the outer surface 24*a* of vessel 24. Obviously, one may employ a very simple plug arrangement 16 which may be pulled in the direction of arrow P out of engagement with the outlet end 20*b* of tube 20, thus releasing the adsorbed gas and causing the chilling effect to be passed through the wall of vessel 24 in the direction of arrows R thereby chilling the contents as described above. Such an arrangement may be provided as a disposable chiller or may be of the rechargeable kind in which case a somewhat more robust construction can be justified. In either arrangement, the chiller 10, which at least partially encloses the vessel 24, may be surrounded by an insulating jacket 56 which effectively acts to protect the user from the extreme chilling effect and ensure that the contents of the vessel 24 is chilled rather than the air surrounding it. The outer surface 56a of jacket 56 provides a suitable surface for advertising matter.

Figure 10:
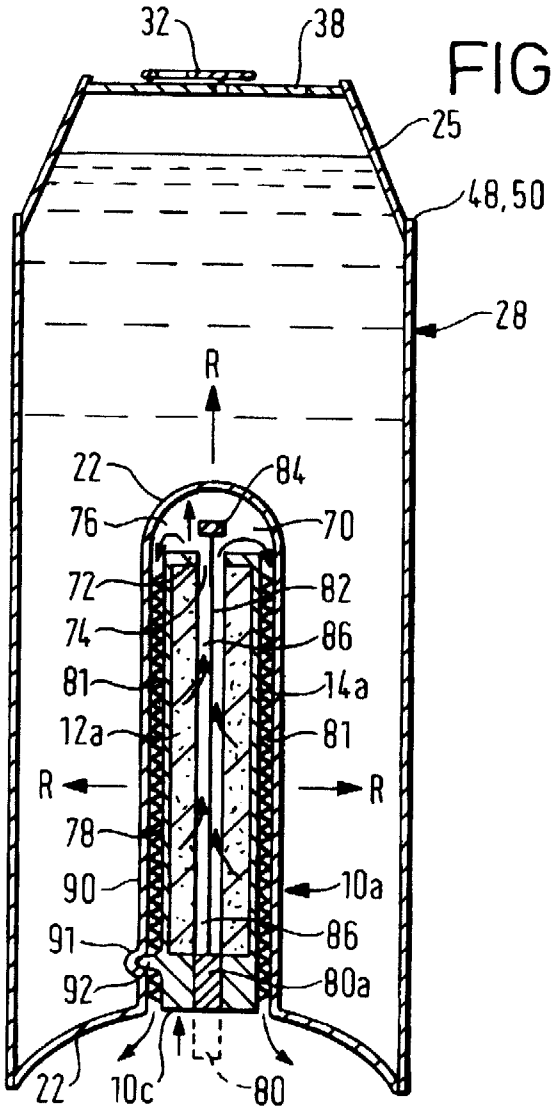
Figure 9:
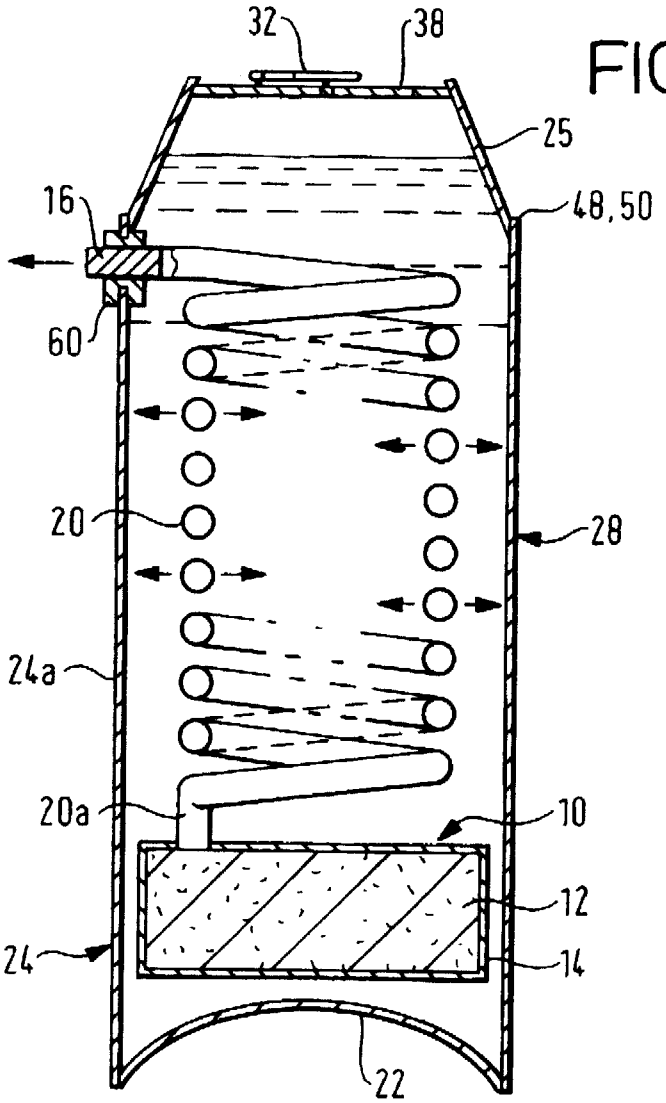

Two further embodiments are illustrated in FIGS. 9 and 10. In FIG. 9 the outlet end 20*b* of tube 20 terminates in an "O-ring" plug 60 having plug 16 located therein. The "O-ring" 60 is suitably sealed against the vessel wall 24*a*, and the tube 20 so as to present any leakage. Other alternatives will however present themselves to a person skilled in the art. Operation of this embodiment is similar to that described above save for the fact that one may remove the plug 16 without having to open the vessel, thereby cooling the contents before dispensing. Such an arrangement would be well suited for use in beer cans employing the well known "draught" systems.

FIG. 10 illustrates a still further embodiment in which the vessel 24 is provided with a longitudinally extending recess 70 formed by deforming the base 22 during the manufacturing process. This recess 70 is used to retain a self-contained chiller 10 in many ways similar to that described above. In particular, the chiller 10 comprises the outer casing 14 housing the adsorbent 12 which has at its upper end 72 an outlet 74 for allowing adsorbed gas to be desorbed into a head-space 76 formed above the chiller itself. The outer surface 78 of casing 14 is formed in a turned manner so as to produce or a plurality of spiral passages 80 extending between the headspace 76 and the base end. The diameter of the outer surface 78 is selected such that, once inserted, the chiller 10 is a close fit up against the outer wall 90 of recess 70, thus making passages 80 into closed passages bounded by outer wall 90. A plunger 80, rod 82 and plug 84 arrangement is provided in linked manner through a central passageway 86 formed through adsorbent 12. In its inactivated position, plunger 80 protrudes beyond the base 10*c* of the chiller and acts to cause plug 84 to seal outlet 74. Further features of this arrangement include a latching arrangement in the form of indent 91 and detent 92 on the recess 70 and chiller 10, respectively. Once inserted, the latching arrangement acts to secure chiller 10 in recess 70 and prevents the chiller 10 from being inadvertently removed during chilling.

Operation of the FIG. 10 embodiment involves insertion of the chiller 10 into recess 70 and depression of plunger 80 to position 80*a* such that plug 82 is driven from outlet 74 and adsorbed gas is desorbed into head-space 76. The close fit of the spiral passages 80 against the outer wall 90 of recess 70 acts to define a region of good thermal conductivity thus allowing escaping gas to chill the contents of the vessel 24 through the recess 70. Chilled beverage will tend to move away from the recess 70 and be replaced by relatively warm beverage for subsequent chilling. Clearly, this arrangement has the advantage of providing the user with a chiller 10 which need only be used when it is not possible to chill the beverage by more conventional means or when one simply desires to provide additional chilling.

I claim:

1. A chiller for chilling a quantity of fluid in a vessel, said chiller comprising an adsorbent for receiving and adsorbing a quantity of gas under pressure; sealing means for sealing the adsorbed gas in said adsorbent and releasing means for releasing adsorbed gas from said adsorbent in a controlled manner such that the action of desorption causes a reduction in the temperature of the adsorbent and the gas which acts to chill the fluid.

2. A chiller in accordance with claim 1, wherein said adsorbent is selected from the group comprising: zeolites, cation exchanged zeolites, silica gel, activated carbons and carbon molecular sieve.

3. A chiller in accordance with claim 2, wherein said adsorbent comprises activated carbon.

4. A chiller in accordance with claim 1, wherein the gas is at least partially carbon dioxide.

5. A chiller in accordance with claim 1 further including an elongated tube in fluid connection at one end with the adsorbent and at the other end with the sealing means, thereby defining a passageway through which adsorbed gas passes as it is released from the adsorbent.

6. A chiller in accordance with claim 5, wherein said chiller is adapted to at least partially enclose said vessel thereby chilling the outer surface thereof.

7. A chiller in accordance with claim 1, wherein the elongated tube has a spiral configuration.

8. A chiller in accordance with claim 5, wherein said chiller is contained within said vessel.

9. A chiller in accordance with claim 1, wherein the releasing means is distinct from an outlet for the fluid from said vessel.

10. A chiller in accordance with claim 1, wherein the releasing means comprises means for obturating an outlet of the vessel which when operated to open said vessel, also acts to release the adsorbed gas to the atmosphere.

11. A chiller in accordance with claim 10, wherein said releasing means comprises a frangible structure breakable upon opening of said vessel.

12. A chiller in accordance with claim 10 further including an elongated tube in fluid connection at one end with the adsorbent and at the other end with the sealing means, said sealing means comprising a plug inserted into the end of the elongated tube, wherein said releasing means is operably connected to the obturating means such that opening said vessel removes the plug from said tube, thereby releasing the adsorbed gas.

13. A chiller in accordance with claim 12, wherein the tube is positioned for directing escaping gas across the surface of any fluid within the vessel prior to said gas exiting the outlet.

14. A chiller in accordance with claim 10, wherein the fluid contained in the vessel is under sufficient pressure to prevent release of the adsorbed gas and operation of the releasing means to open the vessel simultaneously releases the gas.

15. A chiller in accordance with claim 1, wherein said chiller is removably insertable into a recess formed in the vessel and the outer surface of the chiller defines a plurality of passages which define a gas flow path in contact with the walls of the recess.

16. A chiller in accordance with claim 14, further including a plug at its end which is inserted into said recess, said plug being operably linked to a plunger to cause the plug to be removed from an outlet whereupon the adsorbed gas is desorbed from said adsorbent and passed to said passages to cool the walls of the recess.

17. A chiller in accordance with claim 14, including a latching means for releasably securing the chiller in the recess.

18. A fluid storage vessel provided with a chiller in accordance with claim 1.

19. A vessel in accordance with claim 18, wherein said vessel comprises a beverage can.

* * * * *